United States Patent [19]

Arai et al.

[11] Patent Number: 4,975,032

[45] Date of Patent: Dec. 4, 1990

[54] ROOTS TYPE BLOWER HAVING REDUCED GAP BETWEEN ROTORS FOR INCREASING EFFICIENCY

[75] Inventors: Kiyoshi Arai; Tetsuo Fukagawa; Yutaka Ohtsuka, all of Tokyo, Japan

[73] Assignee: Fuji Jukogyo Kabushiki Kaisha, Tokyo, Japan

[21] Appl. No.: 213,284

[22] Filed: Jun. 29, 1988

[30] Foreign Application Priority Data

Jul. 7, 1987 [JP] Japan ..... 62-170699

[51] Int. Cl.[5] ..... F04C 18/18

[52] U.S. Cl. ..... 418/150; 418/206

[58] Field of Search ..... 418/150, 206; 73/261

[56] References Cited

U.S. PATENT DOCUMENTS

| | | | |
|---|---|---|---|
| 587,907 | 8/1897 | Ames et al. | 418/206 |
| 3,371,856 | 3/1968 | Thelen et al. | 418/206 |
| 3,709,055 | 1/1973 | Grove | 418/206 |
| 4,455,132 | 6/1984 | Messori | 418/206 |
| 4,666,384 | 5/1987 | Kaga et al. | 418/206 X |

FOREIGN PATENT DOCUMENTS

| | | | |
|---|---|---|---|
| 42-3598 | 2/1967 | Japan . | |
| 60-75793 | 4/1985 | Japan . | |
| 10128 | of 1884 | United Kingdom | 418/206 |

OTHER PUBLICATIONS

Kuuki Kougaku Binran, Kiso-hen, Showa 54-nen, Korona Sha Kan ("Air Engineering Manual, Fundamentals Edition", Corona Company Publication 1979, Japan), p. 280.

*Primary Examiner*—John J. Vrablik

*Attorney, Agent, or Firm*—Beveridge, DeGrandi & Weilacher

[57] ABSTRACT

A Roots type blower has two rotors enclosed within a housing and each having alternately and contiguously therearound a plurality of lobes each having an outer profile of a convex arc and recesses each having an inner profile of a concave arc, the lobes of one rotor meshing cyclically in turn with respective recesses in the other rotor as the rotors rotate in opposite direction. The rotors are formed and assembled with their profile in relation to respective pitch circles with such dimensional configuration that the radius of the convex arc of each lobe is smaller than the radius of the concave arc, and that the point of intersection between each convex arc and the concave arc of the adjacent recess of a rotor is positioned outside the pitch circle of that rotor.

4 Claims, 6 Drawing Sheets

ROOTS TYPE BLOWER HAVING REDUCED GAP BETWEEN ROTORS FOR INCREASING EFFICIENCY

BACKGROUND OF THE INVENTION

This invention relates generally to blowers of the Roots type having multiple-lobe rotors and more particularly to a Roots type blower in which, by reducing the variation of the clearance gap between the rotors to a minute value, the volumetric efficiency of the blower is improved.

As is known, Roots type blowers are often used as air or gas blowers for industrial equipment, for example, because of their advantageous features such as simple construction and low frequency of mechanical failure.

A typical conventional blower of this Roots type comprises essentially a housing having a rotor chamber and intake and delivery ports on opposite sides of the rotor chamber, at least one pair of first and second rotors of substantially the same shape and the same radius, and rotatable rotor shafts on which respective rotors are fixedly supported, and which are parallelly disposed at a specific center-to-center spacing distance. Each rotor has at least two blade-like projections each comprising a lobe of convex arcuate profile as viewed in plan view forming the outer projecting part and halves of hollow recess of concave arcuate profile on opposite flank sides of the lobe, the lobes and the recesses being of the same number and being formed alternately and contiguously around the rotor. The radius of the convex arc of the lobes is substantially equal to the radius of the concave arc of the recesses. As described more fully hereinafter, the configuration of the two rotors are so designed that, as the rotors in assembled state rotate, the lobes of each rotor mesh closely but freely with respective recesses of the other in the manner of the teeth or cogs of a pair of enmeshed gears.

In the operation of this blower, the rotors are rotated in mutually opposite direction such as to cause air to be transported mechanically from the intake port, around the outer unmeshed parts of the rotors within the rotating spaces formed between the above described recesses and the semicylindrical inner wall surface of the rotor chamber of the blower housing, and into the delivery port. The parts of the rotors which have thus transported the air then mesh with one another and rotate from the delivery side to the intake side to cyclically repeat the air transporting operation.

For reasons which will be described more fully hereinafter, a certain clearance gap is provided between the confronting surfaces of the enmeshing parts of the rotors so as to prevent binding and ensure smooth action. This clearance gap, which varies with various factors, principally the configuration of the rotor profile, unavoidably permits air to leak therethrough from the delivery side to the intake side. Therefore, in order to obtain a high volumetric efficiency of the blower, this air leakage must be reduced to a minimum. The Roots type blowers in the prior art have not been fully satisfactory in this respect, being accompanied by a number of problems

SUMMARY OF THE INVENTION

Accordingly, it is an object of this invention to provide a Roots type blower in which, by suppressing to a minimum the variation in the magnitude of the minimum clearance gap between the rotors, each rotor lobe can be brought nearer to the recess of the other rotor which engages loosely with that lobe, and by shortening to a minimum the time period during which this clearance gap becomes relatively large, the volumetric efficiency of the blower is increased.

Another object of the invention is to provide a blower as described above in which the displacement volume per revolution for the size rating of the blower is great.

Still another object of the invention is to provide a blower as described above having parts, particularly rotors, which can be easily fabricated at low cost.

According to this invention, briefly summarized, there is provided a Roots type blower comprising a blower housing and a plurality of rotors enclosed within the housing and each having alternately and contiguously therearound a plurality of lobes each formed with an outer profile of convex arcuate shape and recesses each formed with an inner profile of concave arcuate shape, in which the rotors are adapted to rotate in mutually opposite directions in a mutually enmeshed state wherein each lobe of one rotor meshes cyclically in turn with a corresponding recess of the other rotor, the rotors being formed and assembled with said profiles in relation to respective pitch circles and with such dimensional configuration that the radius of said convex arcuate shape of each lobe is less than the radius of said concave arcuate shape of each recess, and that the point of intersection of a tangent to the convex arcuate profile of each lobe and a tangent to the concave arcuate profile of a contiguous recess of a rotor is positioned outside of the pitch circle of that rotor.

The nature, utility, and further features of this invention will become more clearly apparent from the following detailed description with respect to a preferred embodiment of the invention when read in conjunction with the accompanying drawings, briefly described below.

DETAILED DESCRIPTION OF THE INVENTION

Figure 7:
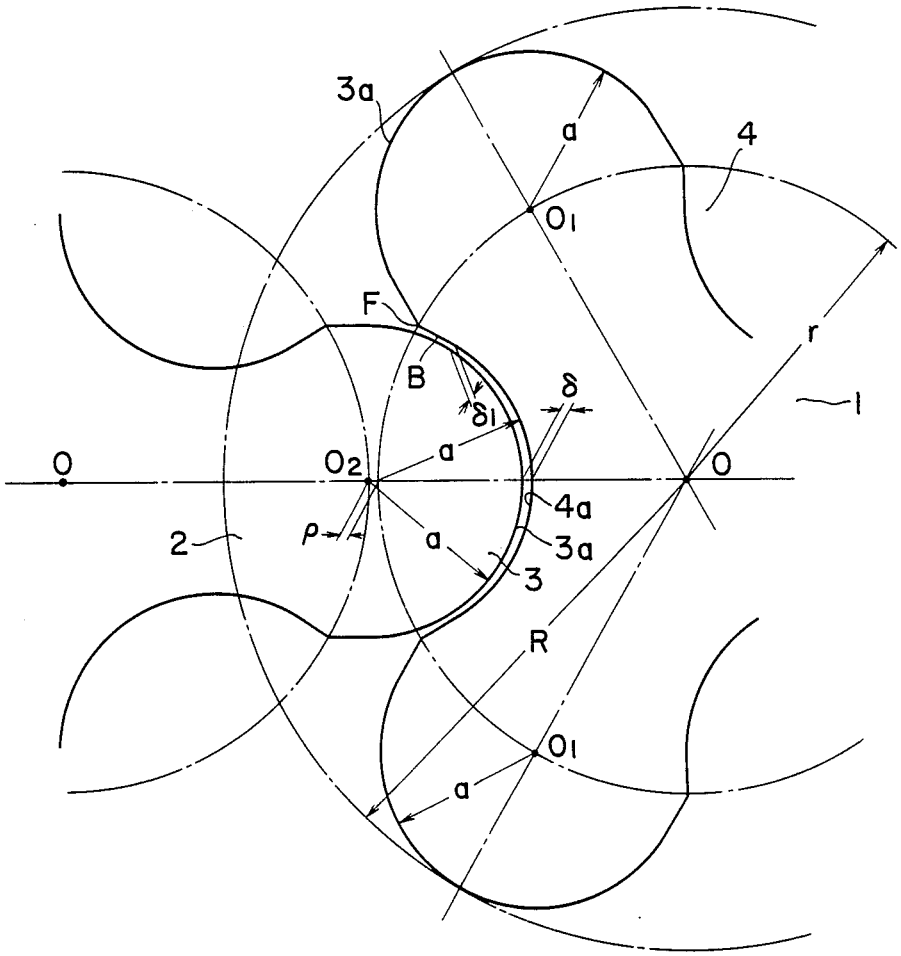
FIG. 7 PRIOR ART
FIG. 7 is a plan view similar to FIGS. 2, 3, and 4 showing the state wherein a lobe of one rotor is enmeshed with a recess in the other rotor in the case of a conventional Roots type blower.

As conducive to a full understanding of the present invention, the general nature, attendant problems, and limitations of a conventional Roots type blower will first be described with reference to FIG. 7.

In a known blower of this type, as described, for example, in "Kuuki Kougaku Binran, Kiso-hen", Showa 54-nen, Korona Sha Kan ("Air Engineering Manual, Fundamentals Edition", Corona Company publication, 1979, Japan), page 280, each rotor has a center O and a pitch circle of a radius r equal to $\frac{2}{3}$ of the aforementioned radius R of the rotor with a center coincident with the center O of the rotor. At three points dividing the circumference of this pitch circle into three equal parts are located three centers $O_1$. With each center $O_1$ as a center, an arc of radius a equal to $\frac{1}{2}$ of the radius r (or $\frac{1}{3}$ of the radius R) is drawn on the outer side of the pitch circle, the ends of this arc intersecting and terminating at points F on the pitch circle. The arc 3*a* thus drawn forms the outer convex profile in plan view of a lobe 3 of the rotor. Similarly the other rotor also has three lobes 3 with arcuate outer profiles 3*a* of a convex arc with centers $O_2$.

Between two lobes 3 of each rotor, the rotor is formed with an arcuate recess 4 of a planar profile of a concave arc 4*a* drawn with a radius a about the intersection of the pitch circle of that rotor and the straight line joining the respective centers 0, O of the two rotors 1 and 2. The ends of each arc 4*a* terminate on the pitch circle of its rotor at the points F where the arcs 3*a* of the nearest lobes 3 terminate on the pitch circle.

Ideally, it is desirable that each lobe 3 of one rotor be in full and snug contact along its entire profile length with the entire profile length of its mating recess 4 of the other rotor. In actual practice, however, as the rotors 1 and 2 rotate, they undergo expansion as a result of causes such as heat generated by the compression of air, and the rotation becomes difficult in some cases. Accordingly, the centers O, O of the rotors 1 and 2 are spaced apart by a distance equal to twice the radius r of the pitch circle plus a clearance gap distance $\delta$. Consequently, a phase gap $\rho$ of the same value as the gap $\delta$ is set between the circumferences of the pitch circles of the rotors 1 and 2, that is, for example, between the center $O_2$ of the lobe 3 of the rotor 2 mating with the concave arc 4*a* of the rotor 1 and the pitch circle of the rotor 1.

As a result, a clearance gap $\delta$ is formed between the concave arc 4*a* of one rotor and the confronting outer extremity of the convex arc 3*a* of the other rotor. For reasons of geometry of the rotors as described above, this gap $\delta$ progressively decreases toward the intersection point F between the convex arc 3*a* and the concave arc 4*a* and, in the vicinity of the intersection F, assumes a minimum value $\delta_1$ which is even less than the value $\delta$. Then, as the lobe 3 of the rotor 2 and the recess 4 of the rotor 1, in this state, are rotated in mutually almost contacting state, the part at which this minimum gap $\delta_1$ is formed progressively shifts, and, moreover, the magnitude of this minimum gap $\delta_1$ also varies progressively.

Figure 6:
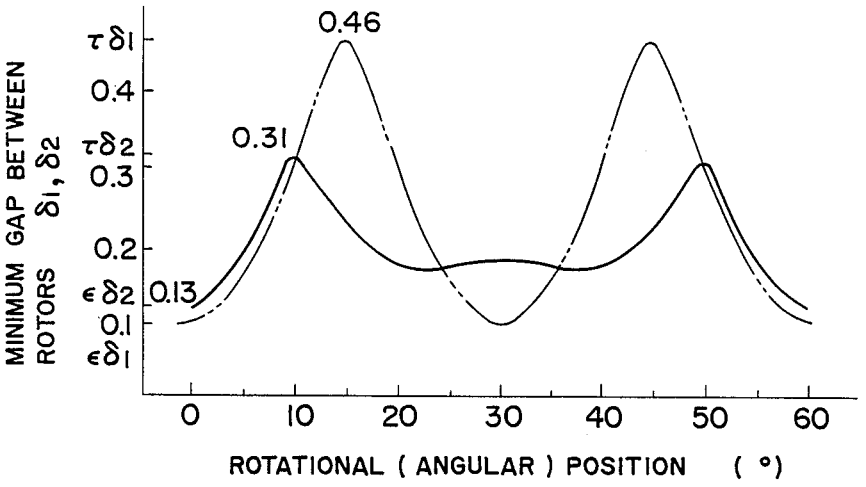
FIG. 6 is a graph indicating the fluctuations of minimum clearance gaps between rotors with rotational angle of the rotors, respectively in the case of a conventional blower and the case of a blower of this invention.

More specifically, as indicated by the chain-line curve in FIG. 6, the minimum gap $\delta_1$ assumes its greatest value $\tau\delta_1$. When the rotors are in a state wherein they have been rotated through approximately 15 degrees of angle from their state indicated in FIG. 7 (taken as the 0 degree state) wherein the extension of the centerline of a lobe 3 of the rotor 2 passes through the center O of the rotor 1. When the rotors have been rotated through approximately 30 degrees from the 0 degree state, the minimum gap $\delta_1$ assumes its smallest value $\epsilon\delta_1$. Then, as the rotors rotate further, the value of the minimum gap $\delta_1$ varies cyclically between its smallest value $\epsilon\delta_1$ and its greatest value $\tau\delta_1$.

The aforementioned clearance or gap $\delta$ is set to correspond to this smallest minimum gap $\epsilon\delta_1$. Because of restriction imposed by the required degrees of precision in the fabrication of the rotor profile and the assembly of the rotors, it is difficult to reduce this gap $\epsilon\delta_1$ below a certain value. For this reason, in the case where the difference between this gap $\epsilon\delta_1$ and the above mentioned gap $\tau\delta_1$ is great, there is a possibility of a large quantity of leakage of air from the delivery side to the intake side of the blower housing through the gap $\tau\delta_1$ when the minimum gap $\delta_1$ assumes this greatest gap $\tau\delta_1$. This leakage of air gives rise to the problem of lowering of the volumetric efficiency of the Roots blower.

As measures for countering this problem, proposals have been made to form rotors with profiles that are epicycloidal curves, hypocycloidal curves, and specific modifications of the rotors as described above thereby to reduce to a minimum the quantity of air leaking through the gap $\delta$ or the minimum gap $\delta_1$, as disclosed in, for example, Japanese Patent Publication No. 3598/1967 and Japanese Patent Laid-Open Application No. 75793/1985. According to these proposed measures, however, the fabrication of the rotors is complicated because of nature of the required profiles. Furthermore, in comparison with Roots blowers having rotors of profiles of arcuate shape, these proposed rotors entail the difficulty of increasing the displacement volume of the blower.

The above described difficulties have been overcome by this invention, which will now be described with respect to a preferred embodiment thereof with reference to FIGS. 1 through 6.

Figure 5:
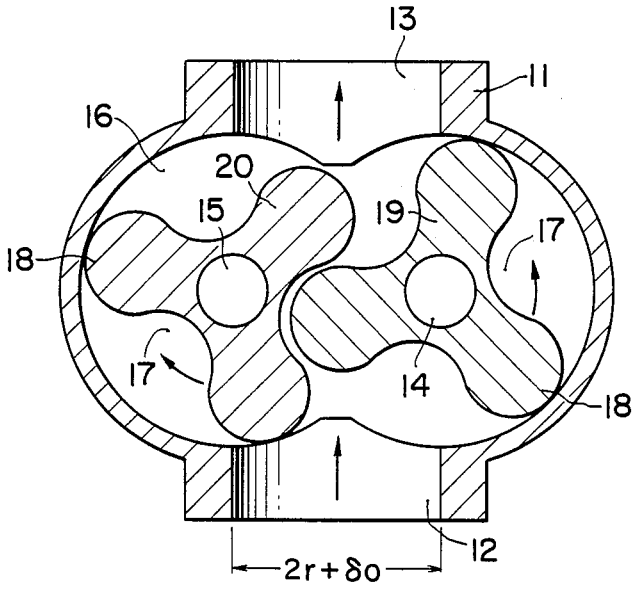
FIG. 5 is a longitudinal sectional view of a Roots type blower, wherein the profiles of the rotors are in plan view.

Referring first to FIG. 5, the example of the Roots blower according to this invention shown therein comprises, as its principal parts, a blower housing 11 having a rotor chamber 16 and intake and delivery ports 12 and 13 on opposite sides of the rotor chamber 16, an intermeshed pair of rotors 19 and 20 enclosed within the rotor chamber 16, and parallel rotor shafts 14 and 15 respectively fixed to and supporting the rotors 19 and 20 and disposed on a line which is perpendicular to the centerlines of the intake and delivery ports 12 and 13.

Each of the rotors 19 and 20, as viewed in plan view as shown in FIGS. 1 through 5, has three lobes 18, for example, and three recesses 17 interposed between the lobes 18. Each lobe 18 of one rotor is adapted to loosely fit in and engage with a corresponding recess 17 of the other rotor. When the rotor shafts 14 and 15 are respectively driven in counterclockwise and clockwise directions, air is pumped by the rotors 19 and 20 from the intake port 12 to the delivery port 13.

The above description is applicable to a typical Roots blower in general. The novelty and what we believe to be the inventiveness of this invention lie in the shape of the rotors 19 and 20 as will now be described with respect to one rotor 19 as an example and with reference to FIG. 1, in which those parts that are the same as or similar to corresponding parts in FIG. 7 are designated by the same reference numerals and characters.

The extreme outer tips of the three lobes 18 of the rotor 19 in plan view lie on a common circle having a center coinciding with the center O of the rotor 19 and a radius R The rotor has a pitch circle with the same center O and a radius r equal to ($\frac{2}{3}$) R. The circumference of this pitch circle is divided into six equal parts at six points of division. At one of these points is positioned the center $O_1$ of a convex arc 22 forming the outer profile curve of one of the lobes 18 and, at an adjacent divisional point is positioned the center $O_2$ of a concave arc 23 forming the profile curve of the bottom part of the recess 17 adjacent to the lobe 18.

The above mentioned convex arc 22 is formed as an arc of a radius equal to a radius minus a minute dimension $\delta a_o$, where a=r2, formed on the outer side of the pitch circle about the center $O_1$. At the same time, the above mentioned concave arc 23 is formed as an arc of a radius equal to the radius a plus a minute dimension $\delta a_1$ formed on the inner side of the pitch circle about the center $O_2$.

Furthermore, the intersection K between the above mentioned convex arc 22 and the adjacent concave arc 23 is determined in the following manner.

First, the intersection between the straight line A joining the centers $O_1$ and $O_2$ of the convex and concave arcs 22 and 23 and the concave arc 23 is designated as point D. A straight line B is drawn to pass through the center $O_1$ and be at a minute angle $\beta$ (for example 12 degrees) relative to the line A on the side of the line A away from the pitch circle of the rotor 19, and the point at which this line B intersects the concave arc 23 is designated as point I. A straight line C is drawn through this point I perpendicularly to the line B.

Furthermore, a straight line G is drawn to pass through the center $O_1$ and be at an angle $\gamma$ equal to or greater than ($30°+\beta$) (in this example 42 degrees) relative to the line B on the side of the line B nearer the outer tip of the lobe 18. The intersection of this line G and the convex arc 22 is designated as point J, and a line L perpendicular to the line G is drawn through this point J. Then, the intersection of this line L and the line C is designated as the aforementioned point K. This point K is positioned outside of the pitch circle of the rotor 19.

Experimentation has proven that values of 2 degrees for angle $\beta$ and $\Delta$ degrees for angle $\gamma$ provide a remarkably, workable small gap between the rotors. These optimum values resulted due to the face that, when the value of angle $\beta$ is fixed, the gap is relatively too large when the value of angle $\gamma$ is 38 degrees while the gap is relatively too small when the value of angle $\gamma$ is 46 degrees. Similarly, when the value of angle $\gamma$ is fixed, the gap is relatively too large when the value of angle $\beta$ is 0 degrees while the gap is relatively too small when the value of angle $\beta$ is 4 degrees.

Then, after the outer profile of each rotor lobe 18 and its adjacent recess 17 has been determined in the above described manner, the contour of the lobe at the angle JKI is rounded by a specific radius of curvature $R_o$. The radius of curvature $R_o$ is determined by drawing a centerline through the center $O_1$ and the point K. The center of the radius of curvature $R_o$ is located along the centerline such that the line L extending from the profile curve of the lobe 18 and the line extending from the profile curve of the recess 17 are joined by a smooth fair curve, whereupon the outer profiles of the rotors 19 and 20 are determined.

Figure 1:
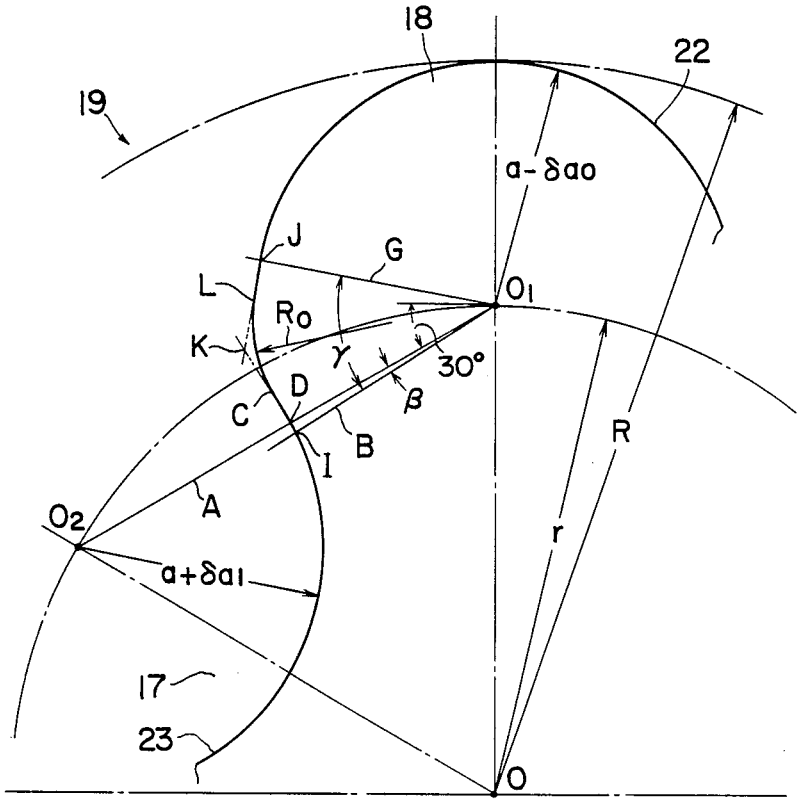
FIG. 1 is a plan view, with parts cut away, showing the profile of an example of a rotor of a blower according to this invention and geometric features thereof.
Figure 2:
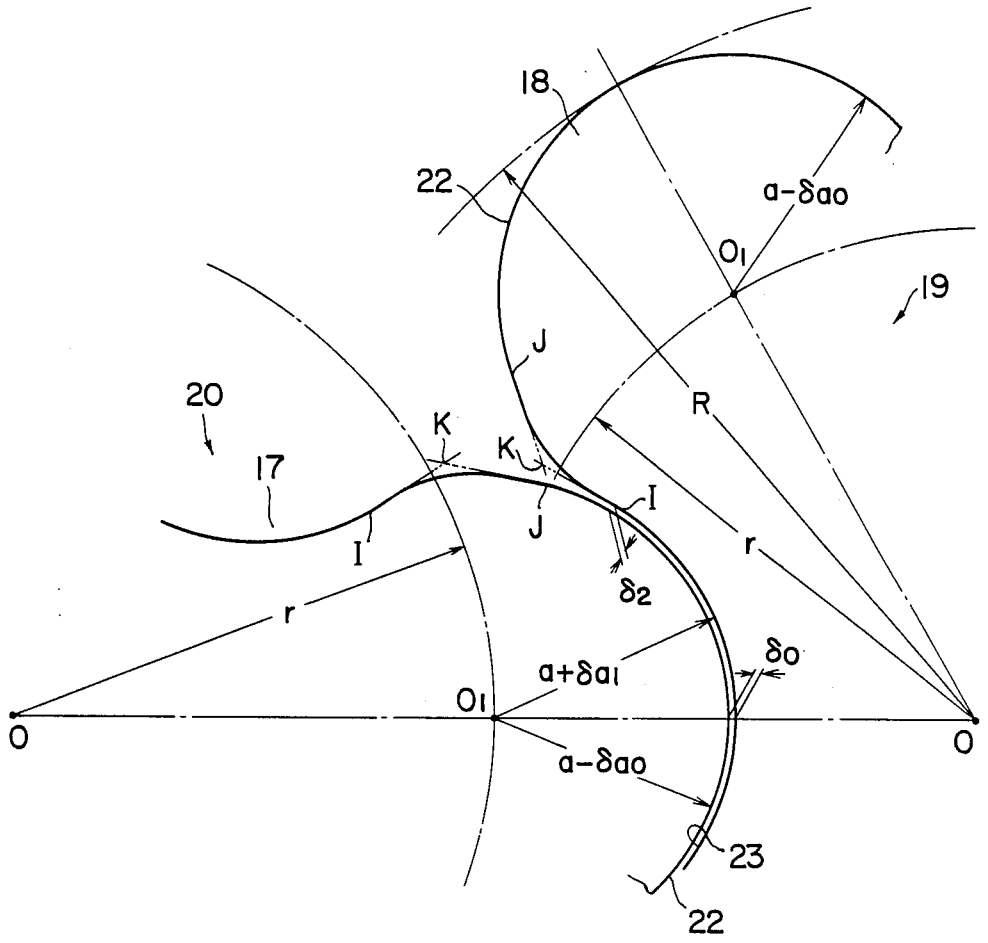
FIG. 2 is a similar plan view indicating geometric relations between a lobe of one rotor enmeshed with a recess of the other rotor during the operation of the blower.

The center-to-center spacing distance between the rotor shafts 14 and 15 on which the rotors 19 and 20 are fixedly mounted is set at 2r so that, when the rotors 19 and 20 are so fixed on their shafts and rotated that the center O of one rotor 19 lies on the extension of the lobe centerline of the other rotor 20 as shown in FIG. 2, the extreme outer tip of the lobe 22 of the rotor 20 will confront the bottom of the corresponding recess 23 of the other rotor 19 with a specific clearance gap $\delta_o$ therebetween. That is, the gap $\delta$ becomes $\delta a_o+\delta a_1$.

For this reason, this clearance gap $\delta$ assumes a minimum value $\delta_2$, which is less than the gap $\delta$, in the vicinity of the point K determined on the lobe 18 of the rotor 19.

Figure 3:
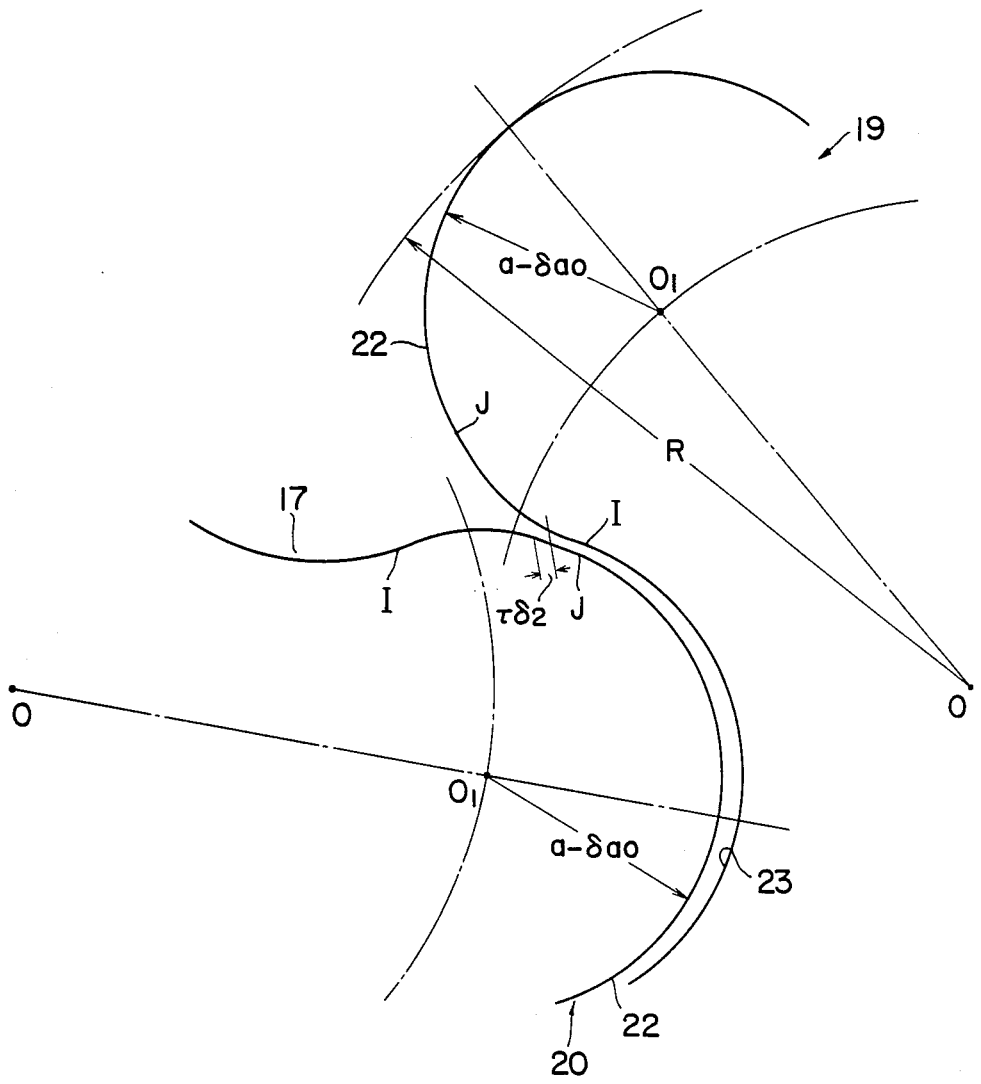
FIG. 3 is a similar plan view indicating the operational state wherein the rotors have rotated through 10 degrees from the state indicated in FIG. 2.
Figure 4:
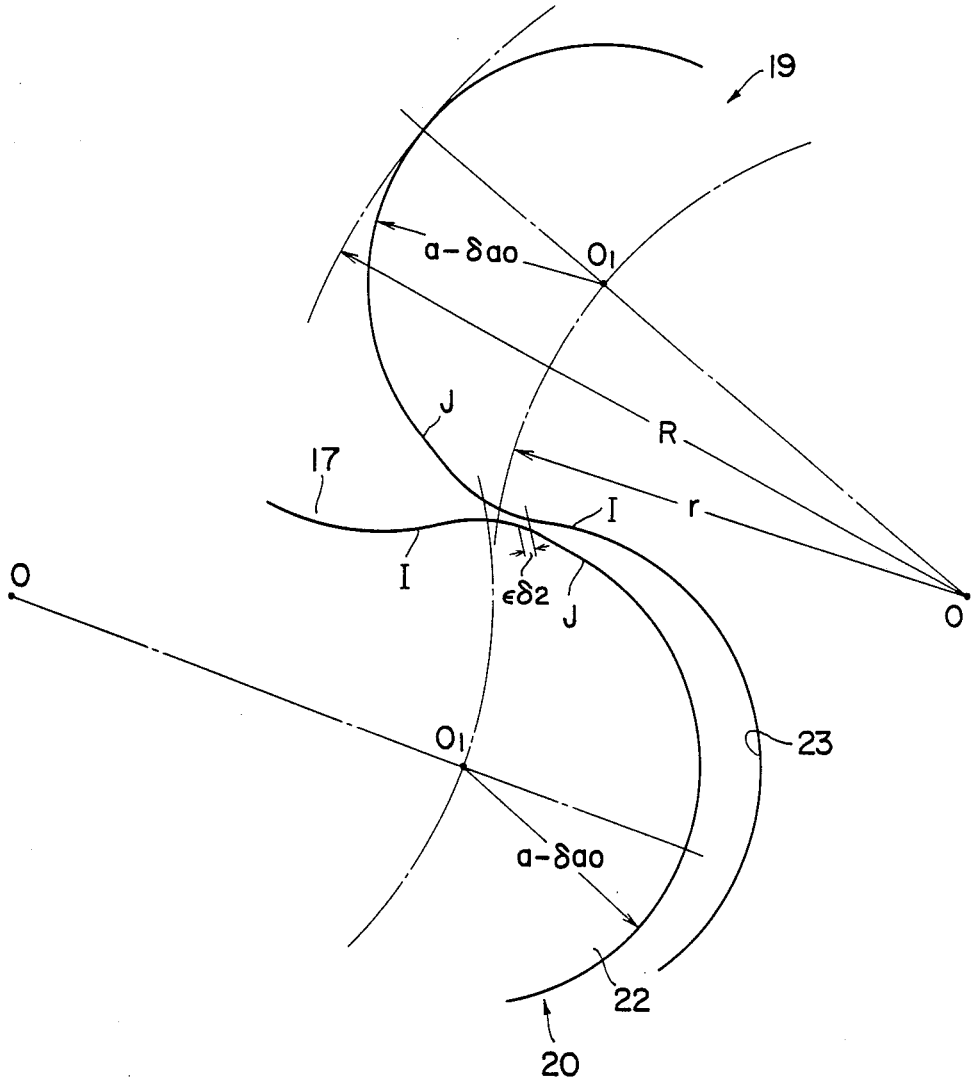
FIG. 4 is a similar plan view indicating the operational state wherein the rotors have rotated through 20 degrees from the state indicated in FIG. 2.

In a Roots type blower of the above described geometric configuration, when the rotors are gradually rotated from the state indicated in FIG. 2 (state of 0 degree of angle), wherein the lobe 18 of one rotor 20 is loosely fitted in the recess 17 of the other rotor 19, and the extension of the centerline of this lobe 18 passes through the center or rotational axis of the rotor 19, the portion in which the minimum gap $\delta_2$ occurs gradually shifts, and at the same time the magnitude of this minimum gap $\delta_2$ also varies gradually as indicated by the solid-line curve in FIG. 6. Then, when this rotation proceeds and reaches approximately 10 degrees as indicated in FIG. 3 from the state indicated in FIG. 2, the minimum gap assumes its greatest value $\tau\delta_2$. Then, when the rotation progresses further and reaches approximately 20 degrees as indicated in FIG. 4 from the state of FIG. 2, the minimum gap assumes its smallest value $\epsilon\delta_2$.

Thereafter, as the rotation progresses further and becomes approximately 30 degrees from the state of FIG. 2, the minimum gap $\delta_2$ widens slightly, but at a rotational angle of approximately 40 degrees, the gap $\delta_2$ again assumes its smallest value $\epsilon\delta_2$ approximately 50 degrees, again assumes its greatest value of $\tau\delta_2$. This variation in magnitude is cyclically repeated thereafter.

Although the minimum clearance gap fluctuates in this manner between its greatest value $\tau\delta_2$ and its smallest value $\epsilon\delta_2$, the difference between these extreme values is remarkably small in comparison with that of a conventional Roots type blower. Therefore, the smallest minimum gap $\epsilon\delta_2$ can be easily set at a reasonable value, and at the same time, the time during which the minimum gap is assuming its greatest value $\tau\delta_2$ is considerably shorter than that of a conventional Roots type blower. For this reason, it is possible to reduce to minimum occurrences of leakage of air through the clearance gap $\delta_o$.

In the above described example of the invention, the radius of the concave arc 23 defining the recess 17 has been described as being set at $a+\delta a_1$ and the radius of the convex arc 22 defining the lobe 18 as being set at $a-\delta a_o$. However, even if the concave recess 23 is fabricated with a radius a equal to $\frac{1}{2}$ of the radius r of the pitch circle, there will not be any great fluctuation in the actual effective result. Furthermore, while the above example of this invention has been described with respect to a pair of rotors 19 and 20 each having three lobes 18, the Roots blower according to the invention is not limited to such a structural configuration but is intended to embrace others of rotors each with other numbers of arcuate lobes.

As described above, in the Roots type blower according to this invention, the range of variation of the magnitude of the minimum clearance gap between the rotors has been reduced to a minimum. For this reason, it is possible to position the rotors closer to each other than in the prior art. At the same time, since the time during which the minimum clearance gap exists has been reduced to a minimum, the volumetric efficiency of the Roots type blower of this invention is increased over that of a conventional Roots type blower with arcuate-profile rotors.

Furthermore, since arcuate curves are used to define the profile of each rotor, the fabrication of the rotors is greatly facilitated.

What is claimed is:

1. A Roots type blower comprising:

a blower housing;

a plurality of rotors enclosed within a rotor chamber of said housing, said rotors each having a plurality of lobes and an equivalent number of recesses positioned alternately and contiguously therearound;

said lobes each having an outer convex profile of substantially arcuate shape and said recesses each having an inner concave profile of substantially arcuate shape;

said rotors being adapted to rotate in mutually opposite directions in a mutually enmeshed state whereby each lobe of one rotor meshes cyclically in turn with a corresponding recess of the other rotor;

said rotors each being formed and assembled with said profiles in relation to respective pitch circles and with dimensional configurations such that the radius of said convex arcuate profile of each lobe is less than the radius of said concave arcuate profile of each recess and such that a straight line L tangent to a point J on said convex arcuate profile of each lobe and a straight line C tangent to a point I on said concave arcuate profile of a contiguous recess intersect at a point of intersection K positioned outside of said pitch circle of said rotor;

said convex arcuate profile and said concave arcuate profile being joined by a relatively smooth transition arcuate profile;

the extreme outer tips of said lobes of each rotor lying on a common circle having a center O coincident with the center of said rotor and a radius R;

each rotor having a pitch circle which has a center coincident with said center O and a radius r equal to 2R/3;

said arcuate profile of each lobe being symmetrical on opposite sides of a lobe centerline passing through said center O and having a radius which is substantially equal to r/2 and is centered at an intersection point $O_1$ said pitch circle and said lobe centerline;

said arcuate profile of each recess being symmetrical on opposite sides of a recess centerline passing through said center O and through a center point $O_2$ disposed on said pitch circle at a distance equal to r from said intersection point $O_1$;

said point of intersection K being determined by the procedure comprising:

drawing a straight line A between said points $O_1$ and $O_2$;

drawing a straight line B passing through said point $O_1$ and being at an angle $\beta$ relative to said line A on the side of said line A away from said pitch circle, said line B intersecting said arcuate profile of said recess at a point I;

drawing a straight line C through said point I and perpendicular to said line B;

drawing a straight line G to pass through said point $O_1$ and be at an angle $\gamma$ equal to or greater than ($\beta$+30 degrees of angle) relative to said line B on the side of said line B nearer the outer tip of said lobe, said line G intersecting the profile of said lobe at a point J; and drawing a straight L perpendicular to said line G through said point J, the intersection of said line L and said line C being said objective point K.

2. A roots type blower according to claim 1 wherein said straight line L is perpendicular to said line G through said point J and said straight line C is perpendicular to said line B through said point I.

3. A roots type blower according to claim 1 wherein said angle $\beta$ is two degrees.

4. A roots type blower according to claim 1 wherein said angle $\gamma$ is forty-two degrees.

* * * * *